US009072411B2

(12) United States Patent
Corney

(10) Patent No.: US 9,072,411 B2
(45) Date of Patent: Jul. 7, 2015

(54) AIR-VENTED LIQUID DISPENSERS AND REFILL UNITS THEREFOR

(71) Applicant: Richard E. Corney, Akron, OH (US)

(72) Inventor: Richard E. Corney, Akron, OH (US)

(73) Assignee: GOJO Industries, Inc., Akron, OH (US)

( * ) Notice: Subject to any disclaimer, the term of this patent is extended or adjusted under 35 U.S.C. 154(b) by 65 days.

(21) Appl. No.: 13/828,980

(22) Filed: Mar. 14, 2013

(65) Prior Publication Data

US 2014/0263464 A1 Sep. 18, 2014

(51) Int. Cl.
*B67D 3/00* (2006.01)
*A47K 5/12* (2006.01)

(52) U.S. Cl.
CPC ..... *A47K 5/1204* (2013.01)

(58) Field of Classification Search
CPC ..... A47K 5/1204; A47K 5/1207
USPC ..... 222/204, 185.1, 325, 395, 153.04, 222/145.5, 628, 631, 181.2, 181.3, 188, 222/321.7, 481.5, 207–215, 181.1; 604/405
See application file for complete search history.

(56) References Cited

U.S. PATENT DOCUMENTS

| | | | | |
|---|---|---|---|---|
| 2,770,234 | A * | 11/1956 | Nesset et al. | 604/405 |
| 4,142,653 | A * | 3/1979 | Mascia et al. | 222/207 |
| 4,932,561 | A * | 6/1990 | Boxall | 222/54 |
| 4,997,429 | A * | 3/1991 | Dickerhoff et al. | 604/411 |
| 5,238,187 | A * | 8/1993 | Zlotnik et al. | 239/6 |
| 6,053,364 | A | 4/2000 | van der Heijden | |
| 6,386,403 | B2 * | 5/2002 | Parsons et al. | 222/399 |
| 7,806,301 | B1 | 10/2010 | Ciavarella et al. | |
| 7,815,076 | B2 | 10/2010 | Ophardt | |
| 8,602,263 | B2 * | 12/2013 | Baron et al. | 222/153.13 |
| 2006/0278657 | A1 * | 12/2006 | Roatis | 222/129.1 |
| 2008/0149666 | A1 | 6/2008 | LaFlamme et al. | |
| 2011/0031278 | A1 | 2/2011 | Han de Man | |
| 2011/0174840 | A1 | 7/2011 | Law et al. | |

FOREIGN PATENT DOCUMENTS

| | | | | |
|---|---|---|---|---|
| DE | 102011107376 | * | 1/2013 | F04B 9/14 |

* cited by examiner

*Primary Examiner* — Frederick C Nicolas
*Assistant Examiner* — Bob Zadeh
(74) *Attorney, Agent, or Firm* — Calfee, Halter & Griswold LLP

(57) ABSTRACT

Air-vented liquid dispensers are disclosed herein, including refill units for use in connection with such dispensers. A rigid container holds a liquid and has a neck portion. A manifold is secured to the neck portion underneath the container, and includes an air passage for air to enter into the container and a liquid passage for air to exit the container. A gasket member is located between the container neck and the manifold, and has a flexible and resilient flap portion which acts as a check valve for the air passage. An air tube carries the air up into the rigid container.

15 Claims, 3 Drawing Sheets

PRIOR ART

AIR-VENTED LIQUID DISPENSERS AND REFILL UNITS THEREFOR

TECHNICAL FIELD

The present invention relates generally to liquid dispenser systems and more particularly to air-vented liquid dispensers, as well as refill units for use with such dispensers.

BACKGROUND OF THE INVENTION

Liquid dispenser systems, such as liquid soap and sanitizer dispensers, provide a user with an amount of liquid upon actuation of the dispenser. It is desirable to provide such a dispenser having a rigid container that is vented with air so that the pump may re-prime itself after a dispensing action. It is also desirable to provide such a dispenser that is easily recharged once the container runs out of liquid to dispense, and that is inexpensive to produce.

SUMMARY

Air-vented liquid dispensers are disclosed herein. In one embodiment, a refill unit for a liquid dispenser includes a rigid container holding a liquid and having a neck portion. A manifold of the refill unit is secured to the neck portion underneath the container, and includes an air passage for air to enter into the container and a liquid passage for liquid to exit the container. The refill unit has a gasket member located between the container neck and the manifold, and includes a flexible and resilient flap portion which acts as a check valve for the air passage. An air tube carries the air up into the rigid container.

In another embodiment, an air-vented liquid dispenser system is disclosed herein. In one embodiment, a dispenser system includes a rigid container holding a liquid and having a neck portion. A manifold of the dispenser system is secured to the neck portion underneath the container, and includes an air passage for air to enter into the container and a liquid passage for liquid to exit the container. The dispenser system has a gasket member located between the container neck and the manifold. The gasket member includes a flexible and resilient flap portion which acts as a check valve for the air passage. An air tube carries the air up into the rigid container. A liquid pump of the dispenser system dispenses liquid from the dispenser system.

In this way, a simple and economical air-vented liquid dispenser system including a refill unit is provided.

BRIEF DESCRIPTION OF THE DRAWINGS

These and other features and advantages of the present invention will become better understood with regard to the following description and accompanying drawings in which.

DETAILED DESCRIPTION

Figure 1:
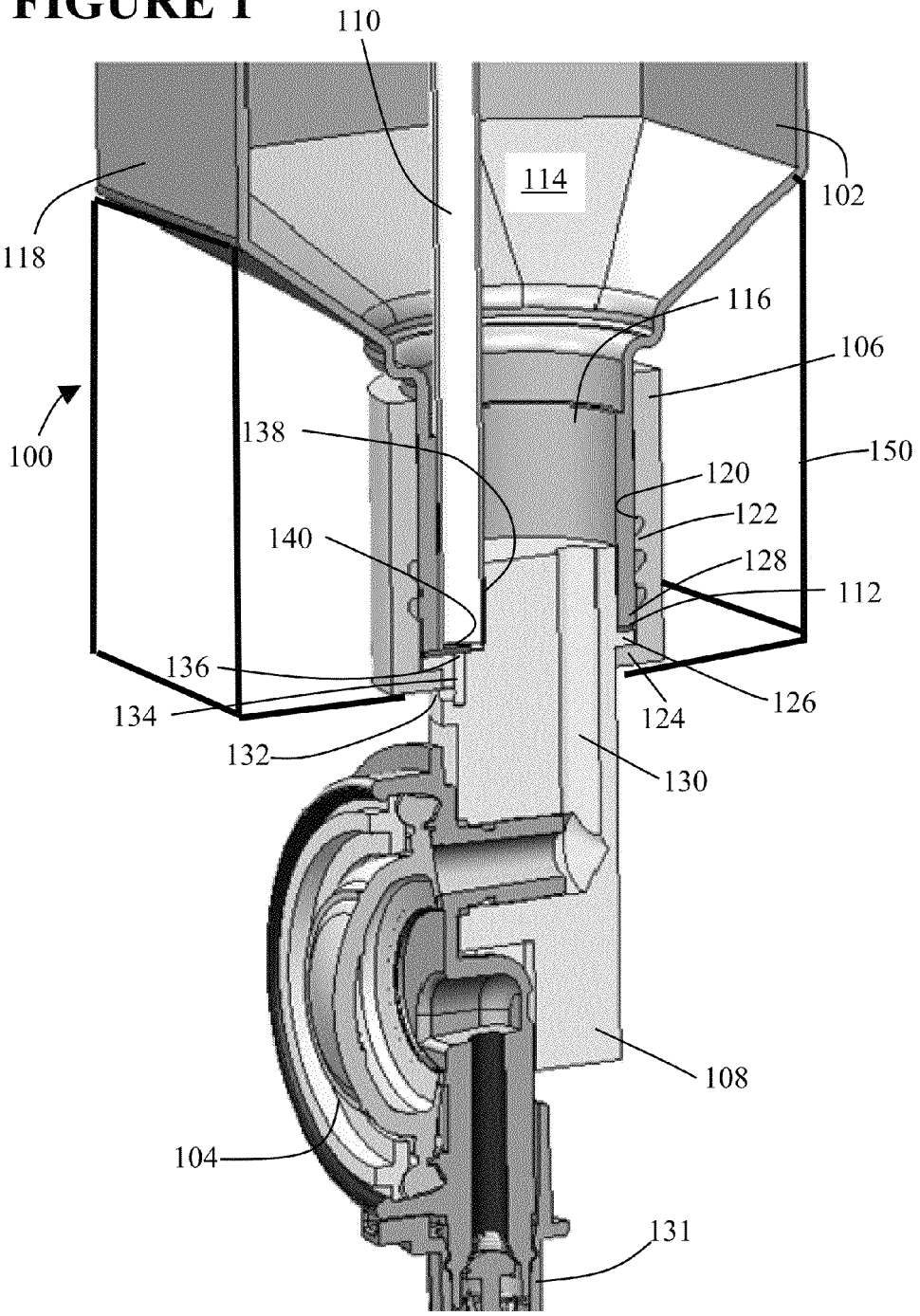
FIG. 1 is a partial cross-sectional view of an air-vented liquid dispenser refill unit 100.
Figure 2:
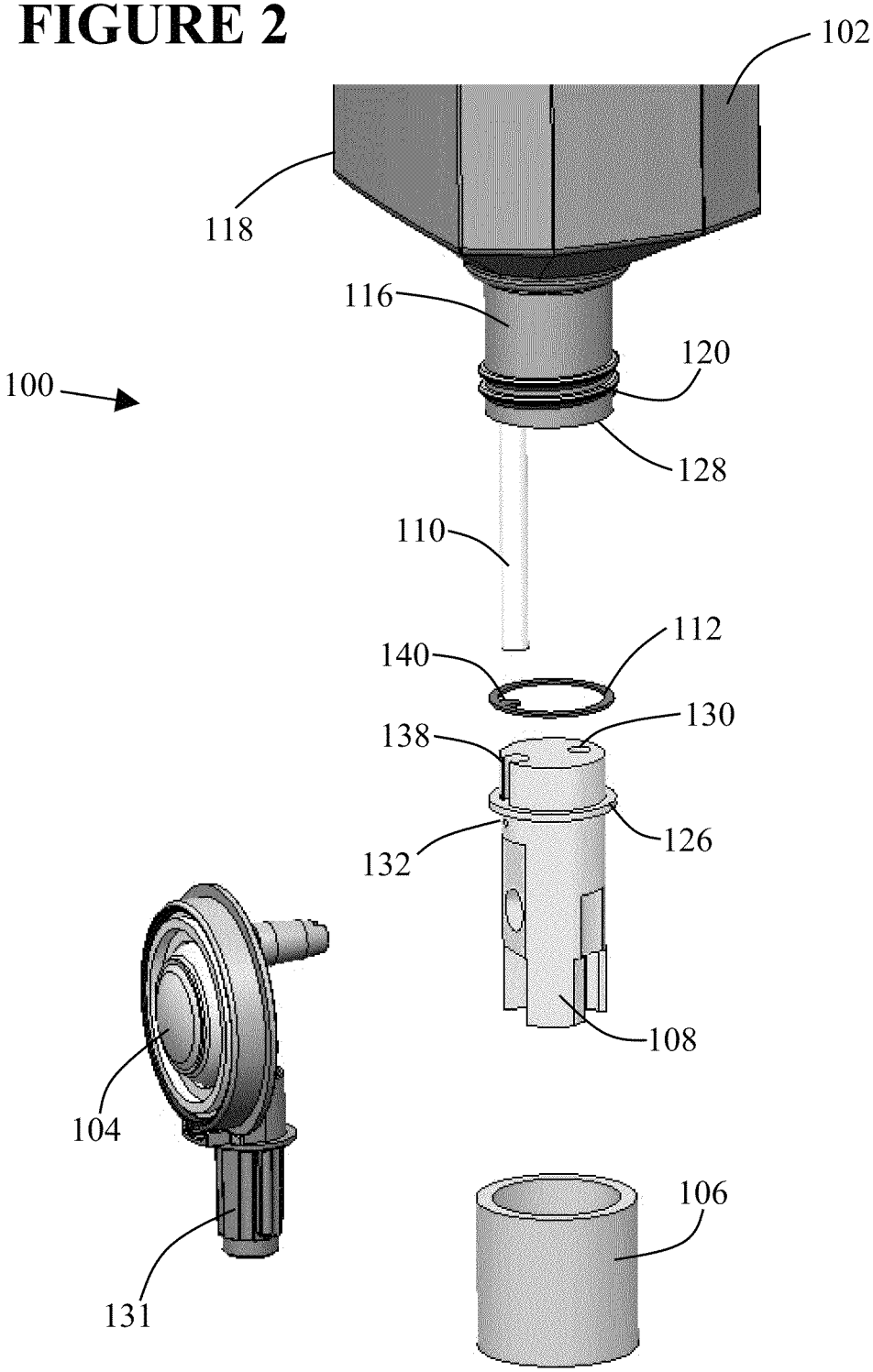
FIG. 2 is a partial exploded view of the air-vented liquid dispenser refill unit 100.

FIGS. 1 and 2 illustrate a first exemplary embodiment of an air-vented liquid dispenser refill unit 100. FIG. 1 is a partial cross-sectional view illustrating the refill unit 100 in an assembled state ready for operation, while FIG. 2 is a partial exploded view illustrating the various parts of the refill unit 100 in an unassembled state. The refill unit 100 includes a rigid liquid container 102 (only partially shown in the Figures), a liquid pump 104, a cap 106, a pump manifold 108, an air tube 110, and a gasket member 112. The refill unit 100 is configured to be placed within or connected to a receptacle (not shown) formed by other components of an overall liquid dispenser system (not shown) to form an operable dispenser.

An exemplary dispenser includes a housing 150 that extends up to at least the lower portion of container 118 to support refill unit 100. In addition, the dispenser includes an opening for outlet 131 to dispense fluid from. Some exemplary dispensers include an lever or actuator to engage the pump 104. Optionally, the housing 150 has an opening and pump 104 is visible for a user to operate the pump 104. In some embodiments, dispenser housing 150 also includes a base to support the dispenser and an open area below outlet 131. In some embodiments, the base provides catches any drips that drip out of outlet 131. When the container 102 of an installed refill unit 100 runs out of liquid for the dispenser system to dispense, it may quickly and easily be replaced by a identical refill unit 100 filled with liquid.

The rigid liquid container 102 stores a supply of liquid within an interior portion 114 of the container 102. The term "rigid", as defined herein, means that the container 102 retains its shape regardless of whether or how much liquid is stored within the container 102, and does not collapse as liquid is dispensed from the container 102. In some instances the walls of the rigid container 102 may bend and flex when placed under even small external pressures. In various embodiments, the contained liquid could be for example a soap, a sanitizer, a cleanser, a disinfectant or some other dispensable liquid.

The container 102 includes a neck 116 which, when the refill unit 100 is in normal use, is disposed at the bottom of the container 102. That is, during normal use, the container 102 is in an inverted position within a liquid dispenser system holding the refill unit 100. The liquid container 102 may advantageously be refillable, replaceable, or both refillable and replaceable within the refill unit 100. In other embodiments the liquid container 102 may be neither refillable nor replaceable within the refill unit 100.

The wall portion 118 of the liquid container 102 may include one or more transparent portions (not shown) so that users of the refill unit 100 may easily determine how much liquid is left within the container 102. The wall portion 118 may also include one or more face portions (not shown) on which product information, advertising information, instructions, or the like are provided.

When the refill unit 100 is assembled as shown in FIG. 1, the cap 106 is attached to the liquid container 102 so that the neck 116 of the container 102 extends into the cap 106. Any means of attachment between the liquid container 102 and the cap 106 may be employed. In the illustrated example, the attachment means comprises threads 120 on an exterior of the neck 116 of the container 102 which mate with corresponding threads 122 on an interior of the cap 106. Alternative attachment means include snap fit arrangements, adhesives, mechanical fasteners, and the like.

The cap 106 has an inward flange portion 124, and the pump manifold 108 has an outward flange portion 126. When the cap 106 is securely attached to the container 102, the inward flange portion 124 of the cap 106 presses the outward flange portion 126 of the pump manifold 108 to capture the gasket member 112 between the flange 126 and an outer lip 128 of the container neck 116. The gasket member 112 forms a liquid seal between the container 102 and the pump manifold 108 so that liquid held within the container 102 will not leak out from the interior chamber 114 when the container 102 is inverted.

The pump manifold 108 has a liquid passage 130 into which liquid stored within the interior 114 of the container 102 may flow under the force of gravity and/or the action of the liquid pump 104. The liquid passage 130 leads to the liquid pump 104. The liquid pump 104 may be operated by a user of the overall liquid dispensing system (not shown) holding the refill unit 100 to dispense a portion of the liquid from the container 102, supplied via the liquid passage 130, to the user. The liquid pump 104 has an outlet 131 which upon actuation of the pump 104 dispenses a dose of liquid directly to the user or to other components of the overall system.

Any suitable liquid pumping mechanism may be employed as the liquid pump. The particular pump 104 illustrated in FIGS. 1 and 2 is an elastomeric dome pump. U.S. Pat. No. 7,806,301 to Ciavarella et al., U.S. Patent Application Publication No. 2008/0149666 to LaFlamme et al., and U.S. Patent Application Publication No. 2011/0031278 to Han de Man each disclose a suitable elastomeric dome pump structure for use as a liquid pump in a liquid dispensing system. Those three references are each hereby incorporated by reference into the present disclosure for their respective teachings regarding elastomeric dome pump assemblies. Other exemplary pumps include piston pumps, bellows pumps, diaphragm pumps, peristaltic pumps, or the like.

When the liquid pump 104 dispenses a liquid dose from the container 102, a vacuum pressure is created within the interior 114 of the container 102. If that vacuum pressure is not relieved, eventually it will prevent the liquid pump 104 from priming, and the liquid dispensing system holding the refill unit 100 will cease operating. To prevent such a situation from arising, the refill unit 100 has an air vent pathway formed therein.

More specifically, the pump manifold 108 has an air inlet 132 leading to an air passage 134. The air passage 134 of the pump manifold 108 leads to an air outlet 136 of the pump manifold 108. The air tube 110 of the refill unit 100 is tightly received within a recess 138 of the manifold 108 so that the air tube 110 surrounds the air outlet 136. The gasket member 112 has a flexible and resilient flap portion 140 (FIG. 2) which, absent pressure being otherwise applied, rests over the air outlet 136 to substantially prevent air from traveling past the flexible flap portion 140 either upwards or downwards within the dispenser 100.

The friction fit between the air tube 110 and the recess 138 wall, in partial conjunction with the gasket member 112, substantially prevents liquid stored within the interior 114 of the container 102 from entering the air pathway near the bottom of the tube 110. The friction fit may also help to hold the flexible flap portion 140 in place underneath the air tube 110. At the same time, the closed flap portion 140 prevents the air within the air tube 110 from escaping down past the flap portion 140. The air thusly trapped within the air tube 110 prevents liquid in the container 102 from entering the top of the air tube 110. In this way the liquid held within the container 102 is substantially prevented from entering the air pathway 110 and 134 even if the container 102 is squeezed by a user or is otherwise subjected to an external pressure such as during air transport.

The flexible flap portion 140 of the gasket member 112 acts as an air check valve in the refill unit 100, as follows. As already mentioned, when the liquid pump 104 is actuated to dispense a portion of the liquid within the container 102, a vacuum pressure is thereby created within the interior 114 of the container 102. With each actuation of the liquid pump 104, more liquid is dispensed, and the vacuum pressure increases. Eventually the vacuum pressure will exceed a minimum pressure which is sufficient to overcome the natural resilience of the flexible flap portion 140. When that occurs, the flap portion 140 will briefly separate from the air outlet 136 of the pump manifold 108, deflecting upwardly into the air tube 110. Air is then free to travel upwardly within the air tube 110 to be released into the interior 114 of the container 102. In that way, the vacuum pressure within the container interior 114 is relieved by the introduction of air from the air tube 110. The vacuum pressure within the interior 114 will resultantly decrease until it once again falls below the minimum pressure needed to overcome the natural resilience of the flexible flap portion 140. At that point its natural resiliency will cause the flap portion 140 to fall back down to its closed position illustrated in FIG. 1, and the air venting cycle begins anew. Depending on the amount of liquid dispensed by each actuation of the liquid pump 104, it may require just one actuation to activate the air check valve 140 or more than one actuation to activate the air check valve 140.

The air tube 110 may extend up into the interior 114 of the container 102 to any convenient height. In a preferred embodiment, the air tube 110 will extend to a height which is in close proximity to an upper wall of the container 102.

As briefly mentioned above, at some point the liquid stored within the liquid container 102 of the refill unit 100 will run out. At that time the empty refill unit 100 may be separated from the other components of the dispensing system (not shown) and replaced with a new refill unit 100 containing a full supply of liquid.

In other embodiments, however, an air-vented liquid dispensing system may be refilled with liquid in additional and alternative ways. In a first such embodiment, a sealable opening (not shown) may be provided in or near a top portion of the liquid container 102 to pour more liquid into the container 102. In a second such embodiment, an empty liquid container 102 may be detached from the cap 106 and replaced with a liquid-filled container 102. The replacement container 102 may either be the same depleted container as before after having been re-filled with liquid via the accessible neck 116, or an entirely new liquid-filled container 102 may take the place of the removed container 102. In the latter event, the new container 102 may include a removable closure (not shown) disposed over the outer lip 128 of the neck 116 to help ensure liquid does not escape from the container 102 during shipment and storage before use.

In one embodiment, the various components of the refill unit 100 may be assembled into a completed refill unit 100 as follows. First, all the individual parts are manufactured. Then, the cap 106, the pump manifold 108, pump 104, the air tube 110, and the gasket member 112 are assembled together as those parts are shown in FIG. 1, to form a sub-assembly. And, the container 102 is placed in an upright position and filled with a liquid to be dispensed. The sub-assembly is then inserted into the container 102, and the cap 106 is screwed into place on the neck 116 of the container 102, to form the completed final assembly of FIG. 1. As the sub-assembly is inserted into the container 102, the closed flexible flap portion 140 traps air within the air tube 110, which in turn prevents liquid from flowing up into the air tube 110 during the assembly process. The completed refill unit may then be installed within a liquid dispenser system (not shown), or shipped to end users for use as a refill unit in pre-existing liquid dispensing systems. In the latter case, a closure mechanism may be placed around or on the outlet 131 of the liquid pump 104 to help prevent liquid from being accidentally dispensed during transport.

As illustrated in FIGS. 1 and 2, the liquid pump 104, the cap 106 and the pump manifold 108 are separable components which are connected together when the refill unit 100 is fully assembled. In alternative embodiments, any two or more of these components may comprise one integral component within the refill unit 100. Various other combinations of different components which combine to form the refill unit 100 are of course also possible. Thus, for example, in some embodiments, the manifold may be incorporated in the pump housing.

Figure 3:
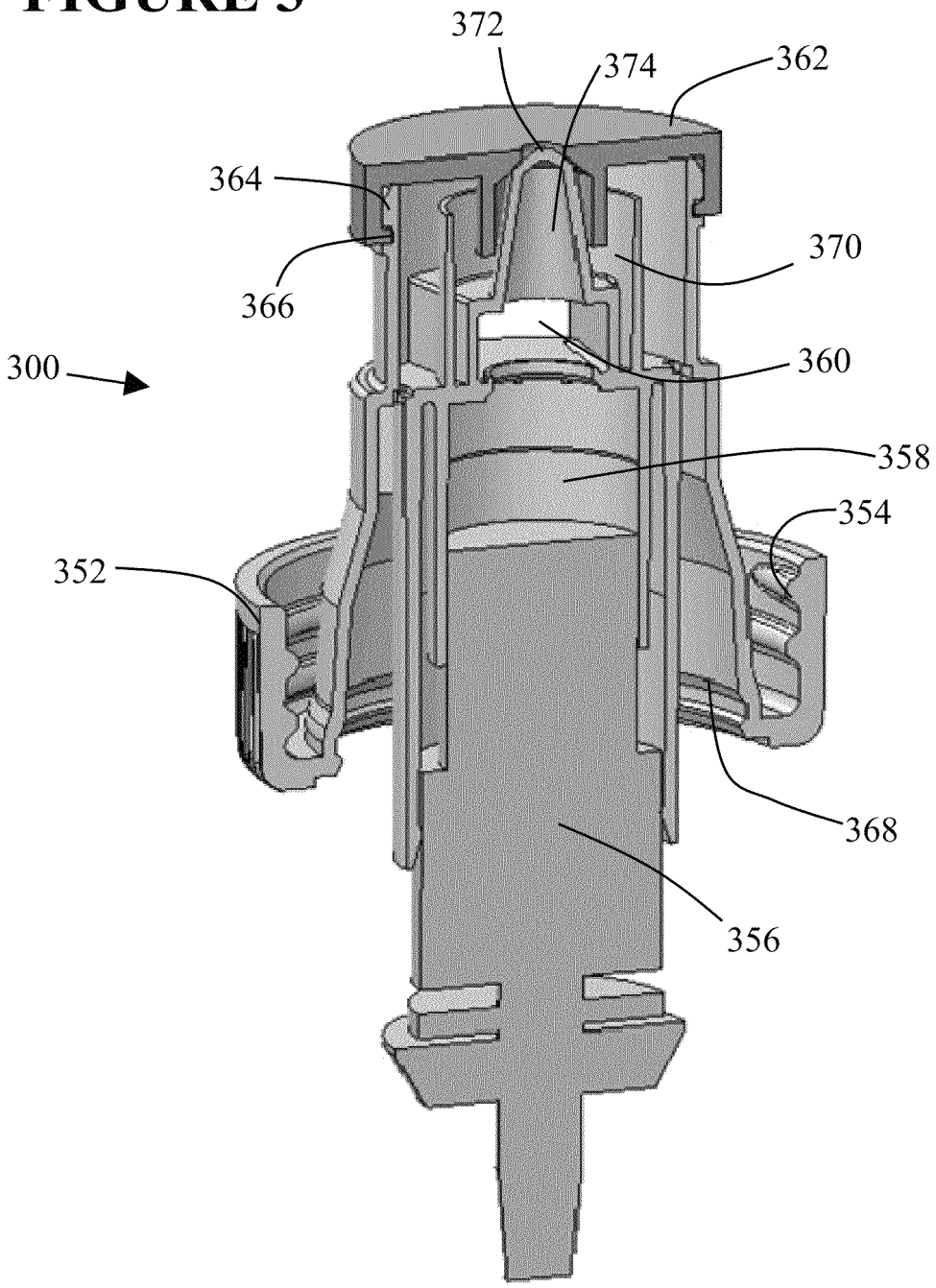
FIG. 3 is a partial cross-sectional view of a part of a prior art air-vented liquid dispenser system 300.

FIG. 3 shows a cross-sectional view of part of a prior art vented liquid dispenser system 300. The prior art system 300 has a cap 352 with a threaded connection 354 for attachment to an inverted container (not shown) containing a liquid above the cap 352. A liquid pump includes a piston 356 which is driven up and down within the cap 352 to dispense liquid from the container. In particular, the movement of the piston 356 draws liquid into a central channel 358 of the cap 352 via a liquid inlet 360 to be dispensed by the piston 356. As a result, a vacuum pressure is created within the interior of the container above the cap 352.

To relieve that pressure, the system 300 includes a flexible and resilient disk member 362 which is tightly snapped onto a top portion 364 of the cap 352 and held in place by engagement with an annular recess 366. An air passageway 368 leads from the external environment up to an air chamber 370 below the disk 362. The disk 362 includes a central aperture 372 which, absent pressure being otherwise applied, engages a central post 374 within the cap 362. In that closed position, liquid is prevented from flowing downwardly past the disk 362 into the air chamber 370 underneath the disk 362 and thereby escaping the system 300 via the air passageway 368. With each dispensing actuation of the system 300, more liquid is dispensed, and the vacuum pressure within the container above the disk 362 increases. Eventually the vacuum pressure will exceed a minimum pressure needed to overcome the natural resilience of the disk 362. When that occurs, the disk 362 will briefly deflect upwardly and separate from the post 374 to allow air into the container above the disk 362. Air travels upwardly into the container, through the liquid held within the container, to be released above the remaining liquid level in the container. In that way, the vacuum pressure within the container is relieved until it once again falls below the minimum pressure to overcome the natural resilience of the disk 362. At that point its natural resiliency will cause the disk 362 to fall back down to its closed position illustrated in FIG. 3. The operation cycle of the valve 362 is quick enough that liquid held within the container is unable to overcome the incoming air pressure to escape through the opening created between the disk 362 and the post 372 to the air passageway 368.

There are clear structural difference between the prior art system 300 of FIG. 3 and the presently disclosed refill unit 100 of FIGS. 1 and 2.

While the present invention has been illustrated by the description of embodiments thereof and while the embodiments have been described in considerable detail, it is not the intention of the applicant to restrict or in any way limit the scope of the appended claims to such detail. Additional advantages and modifications will readily appear to those skilled in the art. Therefore, the invention, in its broader aspects, is not limited to the specific details, the representative apparatus and illustrative examples shown and described. Accordingly, departures may be made from such details without departing from the spirit or scope of the applicant's general inventive concept.

I claim:

1. A refill unit for a liquid dispenser, the refill unit comprising:

a container for holding a liquid and comprising a neck portion;

a manifold secured to the neck portion underneath the container, wherein the manifold comprises an air passage leading from an external environment of the refill unit to an air outlet from the manifold, and the manifold additionally comprises a liquid passage leading from an interior portion of the container;

a gasket member located between the neck portion of the container and the manifold, wherein the gasket member comprises a flexible and resilient flap portion having a natural resilience tending to hold the flap portion in a rest position extending over and covering the manifold air outlet;

an air tube which surrounds the manifold air outlet and the flexible and resilient flap portion above the manifold air outlet, and extends up into the container;

wherein the natural resilience of the flexible and resilient flap portion is overcome by a minimum vacuum pressure generated in the container by liquid being dispensed from the container, such that the flexible and resilient flap portion moves from the rest position to an upright position above the manifold air outlet allowing air to enter the air tube from the external environment, until the vacuum pressure falls below the minimum pressure thus permitting the flexible and resilient flap portion to return to the rest position due to the natural resiliency of the flexible and resilient flap portion.

2. The refill unit of claim 1, further comprising a cap attached to the container so that the neck of the container extends into the cap.

3. The refill unit of claim 2, wherein the cap is attached to the container by a threaded connection or a snap-fit connection between the cap and the container.

4. The refill unit of claim 2, wherein the cap comprises an inward flange portion and the manifold comprises an outward flange portion, such that when the cap is attached to the container, the inward flange portion presses the outward flange portion to capture the gasket member between the outward flange portion and an outer lip of the container neck.

5. The refill unit of claim 1, wherein the liquid comprises at least one of a soap, a sanitizer, a cleanser, or a disinfectant.

6. The refill unit of claim 1, wherein the container comprises one or more transparent portions.

7. The refill unit of claim 1, further comprising a liquid pump connected to the liquid passage of the manifold, such that operation of the liquid pump draws liquid from the container into and then out of the liquid pump in order to dispense liquid from the refill unit.

8. The refill unit of claim 7, wherein the liquid pump comprises an elastomeric dome pump.

9. The refill unit of claim 1, wherein the air tube is received within a recess of the manifold so that the air tube surrounds the air outlet and the gasket member.

10. The refill unit of claim 9, wherein the air tube extends up into the container to a height which is in close proximity to an upper wall of the container.

11. The refill unit of claim 1, wherein the manifold is part of a pump housing.

12. A liquid dispenser system comprising:

a housing for holding a refill unit, the housing having a portion for supporting a refill unit;

a refill unit having a container;

the container for holding a liquid and comprising a neck portion;

a manifold secured to the neck portion underneath the container, wherein the manifold comprises an air passage leading from an external environment of the manifold to an air outlet from the manifold, and the manifold additionally comprises a liquid passage leading from an interior portion of the container to a liquid pump, wherein operation of the liquid pump draws liquid from the container into and then out of the liquid pump in order to dispense liquid from the dispenser system;

a gasket member located between the neck portion of the container and the manifold, wherein the gasket member comprises a flexible and resilient flap portion having a natural resilience tending to hold the flexible and resilient flap portion in a rest position extending over and covering the manifold air outlet;

an air tube which surrounds the manifold air outlet and the flexible and resilient flap portion above the manifold air outlet, and extends up into the container;

wherein the natural resilience of the flexible and resilient flap portion is overcome by a minimum vacuum pressure generated in the container by liquid being dispensed from the container, such that the flexible and resilient flap portion moves from the rest position to an upright position above the manifold air outlet allowing air to enter the air tube from the external environment, until the vacuum pressure falls below the minimum pressure thus permitting the flexible and resilient flap portion to return to the rest position due to the natural resiliency of the flexible and resilient flap portion.

13. The liquid dispenser system of claim 12, wherein the container is separable from other components of the system to permit liquid to be added to the container through the neck portion.

14. The liquid dispenser of claim 12, wherein the container is part of a refill unit which is separable from the housing so that the refill unit is removed from the system and replaced with a replacement refill unit inserted.

15. The liquid dispenser system of claim 12, wherein the manifold is part of a pump.

* * * * *